US009256237B2

(12) United States Patent
Kim et al.

(10) Patent No.: US 9,256,237 B2
(45) Date of Patent: Feb. 9, 2016

(54) LOW DROP-OUT REGULATOR

(71) Applicant: Samsung Electronics Co., Ltd., Suwon-si (KR)

(72) Inventors: Hyoungrae Kim, Hwaseong-si (KR); Dongjin Keum, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 101 days.

(21) Appl. No.: 14/149,410

(22) Filed: Jan. 7, 2014

(65) Prior Publication Data

US 2014/0191739 A1 Jul. 10, 2014

(30) Foreign Application Priority Data

Jan. 7, 2013 (KR) ..... 10-2013-0001702

(51) Int. Cl.
*G05F 1/575* (2006.01)
*G05F 1/56* (2006.01)

(52) U.S. Cl.
CPC . *G05F 1/56* (2013.01); *G05F 1/575* (2013.01)

(58) Field of Classification Search
CPC ..... G05F 1/575; G05F 1/56; G05F 1/573; G05F 3/30
USPC ..... 323/273–277, 280, 281, 303, 312
See application file for complete search history.

(56) References Cited

U.S. PATENT DOCUMENTS 5,982,226 A 11/1999 Rincon-Mora
6,300,749 B1 10/2001 Castelli et al.
6,518,737 B1 * 2/2003 Stanescu et al. ..... 323/280
6,690,147 B2 2/2004 Bonto
6,703,815 B2 * 3/2004 Biagi ..... 323/280
6,703,816 B2 * 3/2004 Biagi et al. ..... 323/280
7,589,507 B2 9/2009 Mandal
7,612,548 B2 11/2009 Jian (Continued)

FOREIGN PATENT DOCUMENTS

EP 1365302 A1 * 11/2003 ..... G05F 1/565
JP 2006-318204 A 11/2006
KR 10-2011-0078479 A 7/2011

OTHER PUBLICATIONS

Mohammad Al-Shyoukh et al; "A Transient-Enhanced Low-Quiescent Current Low-Dropout Regulator With Buffer Impedance Attenuation"; IEEE Journal of Solid-State Circuits; vol. 42; No. 8; Aug. 2007; pp. 1732-1742.
Chunlei Shi, et al.; "A Highly Integrated Power Management IC for Advanced Mobile Applications"; IEEE Journal of Solid-State Circuits; vol. 42; No. 8; Aug. 2007; pp. 1723-1731.

*Primary Examiner* — Adolf Berhane
(74) *Attorney, Agent, or Firm* — Sughrue Mion, PLLC

(57) ABSTRACT

Exemplary embodiments disclose a low drop-out regulator including an error amplification unit which includes a zero compensation circuit configured to compensate a plurality of poles which are generated by an output terminal and a buffer, the error amplification unit is configured to generate a first comparison signal in response to a reference voltage and a feedback voltage, the buffer is configured to generate a second comparison signal in response to the first comparison signal and an input voltage, a pass unit configured to provide an output voltage and a load current to the output terminal in response to the second comparison signal and the input voltage, and a feedback unit configured to provide the feedback voltage to the error amplification unit in response to the output voltage. A driving current of the buffer is independently adjusted with respect to the load current.

18 Claims, 8 Drawing Sheets

(56) References Cited

U.S. PATENT DOCUMENTS

| | | | | |
|---|---|---|---|---|
| 8,080,982 | B2 | 12/2011 | Lin et al. | |
| 8,080,983 | B2 | 12/2011 | Lourens et al. | |
| 2003/0178976 | A1* | 9/2003 | Xi | 323/273 |
| 2008/0157735 | A1* | 7/2008 | Liu et al. | 323/280 |
| 2011/0121800 | A1 | 5/2011 | Drebinger | |
| 2013/0113454 | A1* | 5/2013 | Chen et al. | 323/312 |
| 2014/0266104 | A1* | 9/2014 | El-Nozahi et al. | 323/280 |

* cited by examiner

LOW DROP-OUT REGULATOR

CROSS-REFERENCE TO RELATED APPLICATIONS

This application claims priority from Korean Patent Application No. 10-2013-0001702, filed on Jan. 7, 2013, the entire disclosure of which is hereby incorporated by reference.

BACKGROUND

Exemplary embodiments relate to a voltage regulator used in an integrated circuit. More particularly, exemplary embodiments relate to a low drop-out regulator.

Low drop-out regulators are devices which provide a stable voltage. A low drop-out regulator may be a linear regulator which provides a lower output voltage than an input voltage.

Although the low drop-out regulator has power losses because of an output voltage which is lower than an input voltage, the low drop-out regulator may provide a stable output voltage. The low drop-out regulator may also have superior line and load regulation characteristics. Thus, the low drop-out regulator may be used in various fields, such as power management IC.

SUMMARY

Exemplary embodiments may provide a low drop-out regulator with a wide input voltage range and stable frequency response characteristic.

According to an aspect of an exemplary embodiment, a low drop-out regulators may include: an error amplification unit which includes a zero compensation circuit configured to compensate a plurality of poles which are generated by an output terminal and a buffer, the error amplification unit is configured to generate a first comparison signal in response to a reference voltage and a feedback voltage; the buffer is configured to generate a second comparison signal in response to the first comparison signal and an input voltage; a pass unit configured to provide an output voltage and a load current to the output terminal in response to the second comparison signal and the input voltage; and a feedback unit configured to provide the feedback voltage to the error amplification unit in response to the output voltage, wherein a driving current of the buffer is independently adjusted with respect to the load current.

In some embodiments, the buffer may include a rail-to-rail circuit.

In other embodiments, the rail-to-rail circuit may be a CMOS device.

In still other embodiments, the rail-to-rail circuit may include: a heavy load unit configured to turn on in a heavy load condition in response to the first comparison signal and generate the second comparison signal, and turn off in a light load condition; and a light load unit which is connected in parallel to the heavy load unit, the light load unit configured to turn on in the light load condition in response to the first comparison signal and generate the second comparison signal, and turn off in the heavy load condition.

In even other embodiments, the heavy load unit may include: an input source-follower configured to turn on in the heavy load condition and transmit the first comparison signal to an intermediate node; an output source-follower configured to output the first comparison signal, provided from the intermediate node, as the second comparison signal; and a current mirror configured to turn on in the heavy load condition and provide the driving current to the input source-follower and the output source-follower.

In yet other embodiments, the light load unit may include: an input source-follower configured to turn on in the light load condition and transmit the first comparison signal to an intermediate node; an output source-follower configured to output the first comparison signal, provided from the intermediate node, as the second comparison signal; and a current mirror configured to turn on in the light load condition and provide the driving current to the input source-follower and the output source-follower.

In further embodiments, the zero compensation circuit may include: a compensation capacitor; and a compensation variable resistor configured to vary resistance in response to the load current.

In still further embodiments, the compensation variable resistor may include: a first compensation resistor; a second compensation resistor which is connected in series to the first compensation resistor; and a compensation transistor connected in parallel to the first compensation resistor to form a current channel, wherein the current channel is connected in series to the second compensation resistor.

In even further embodiments, the compensation transistor may be configured to turn off in the light load condition, and the compensation variable resistor may comprise the first compensation resistor and the second compensation resistor connected to each other in series in response to the compensation transistor being turned off.

In yet further embodiments, the compensation transistor may be configured to turn on in the heavy load condition, and the compensation variable resistor may be configured to comprise the first compensation resistor in response to the compensation transistor being turned on.

In much further embodiments, the feedback unit may include: a first feedback resistor which is connected between the output terminal and a feedback node; and a second feedback resistor which is connected between the feedback node and a ground node, wherein the feedback voltage is provided from the feedback node.

In still much further embodiments, the feedback unit may further include a feedback compensation capacitor configured to compensate the poles, and the feedback compensation capacitor is connected between the output terminal and the error amplification unit.

According to another aspect of the exemplary embodiments, an error amplification unit used in a low drop-out regulator may include: an input stage configured to receive a first signal and a second signal; an output stage which is connected to the input stage, the output stage is configured to provide a comparison signal to an output terminal in response to a difference between the first signal and the second signal; and a zero compensation circuit which is connected to the output terminal and is configured to provide a compensation zero to the error amplification unit, wherein a frequency of the compensation zero varies in response to a voltage of the output terminal.

In some embodiments, the zero compensation circuit may include: a compensation capacitor; and a compensation variable resistor configured to vary resistance in response to the voltage of the output terminal.

In other embodiments, the compensation variable resistor may include: a first compensation resistor; a second compensation resistor which is connected in series to the first compensation resistor; and a compensation transistor which is connected in parallel to the first compensation resistor to form a current channel, wherein the compensation transistor is configured to turn on or off in response to the voltage of the output terminal.

According to a further aspect of the exemplary embodiments, a method of a low-drop regulator may include: receiving a reference voltage, a feedback voltage, and an input voltage; generating a first comparison signal in response to the reference voltage and the feedback voltage; generating a second comparison signal in response to the first comparison signal and the input voltage; generating an output voltage and a load current to an output terminal in response to the second comparison signal and the input voltage; and generating a feedback voltage in response to the output voltage, wherein a driving current is independently adjusted with respect to the load current.

BRIEF DESCRIPTION OF THE DRAWINGS

The accompanying drawings are included to provide a further understanding of the exemplary embodiments, and constitute a part of this specification. The drawings illustrate exemplary embodiments, and with the description, serve to explain principles of the exemplary embodiments, in which.

DETAILED DESCRIPTION OF EXEMPLARY EMBODIMENTS

Preferred embodiments of the exemplary embodiments will be described below in more detail with reference to the accompanying drawings, such that those skilled in the art can realize the technical ideas without much difficulty. Also, the technical terms are only used for explain a specific exemplary embodiment, and not for limiting the exemplary embodiments. It should be construed that foregoing illustrations and following detailed descriptions are exemplary, and an additional explanation of the exemplary embodiments is provided.

Figure 1:
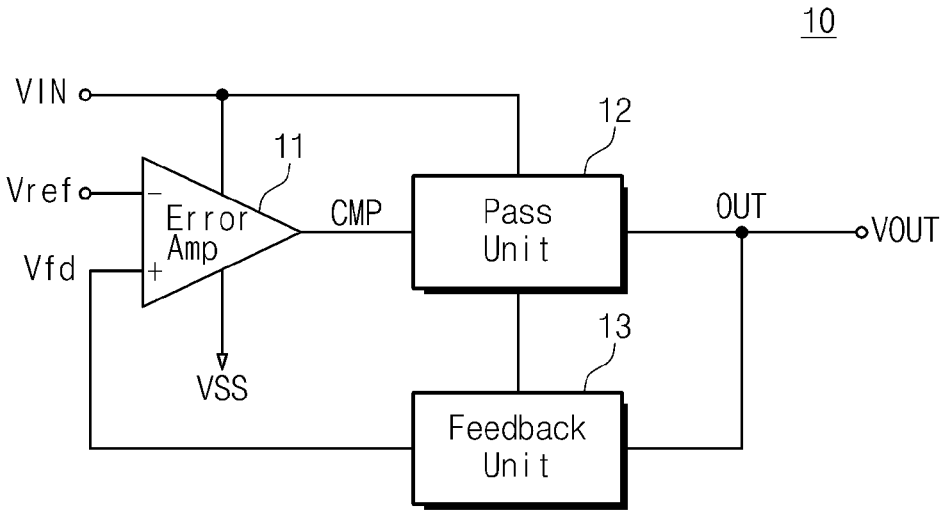
FIG. 1 is a block diagram of a low drop-out regulator.

FIG. 1 is a block diagram of a low drop-out regulator. Referring to FIG. 1, a low drop-out regulator 10 includes an error amplifier 11, a pass unit 12, and a feedback unit 13.

The error amplifier 11 compares a reference voltage Vref to a feedback voltage Vfd. The error amplifier 11 responds to the comparison result by generating a comparison signal CMP, and providing the generated comparison signal CMP to the pass unit 12. The comparison signal CMP includes information with respect to a change in an output voltage VOUT of the low drop-out regulator 10.

The reference voltage Vref may be provided from a reference voltage generation unit which is connected outside of the low drop-out regulator 10. The output voltage VOUT of the low drop-out regulator 10 may be determined on the basis of the reference voltage Vref.

The pass unit 12 responds to the comparison signal CMP and an input voltage VIN, and provides the output voltage VOUT to an output terminal OUT of the low drop-out regulator 10. Also, the pass unit 12 may respond to the comparison signal CMP and the input voltage VIN to control the intensity of current provided to the output terminal OUT.

The feedback unit 13 responds to the output voltage VOUT by generating a feedback voltage Vfd. The feedback voltage Vfd may be a voltage in which the output voltage VOUT is distributed at a predetermined ratio. The feedback unit 13 provides the generated feedback voltage Vfd to the error amplifier 11.

If the output voltage VOUT is changed, the feedback voltage Vfd may also be changed in response to the changed output voltage VOUT. The error amplifier 11 responds to the changed feedback voltage Vfd by generating the comparison signal CMP. The pass unit 12 responds to the comparison signal CMP by changing the output voltage VOUT. Therefore, the output voltage VOUT is stabilized. The low drop-out regulator 10 may maintain the stabilized output using the feedback.

The low drop-out regulator 10 has a heavy load capacitance at the output terminal OUT. A dominant pole is disposed on the output terminal OUT of the low drop-out regulator 10 due to the heavy load capacitance. Since the error amplifier 11 has high output resistance, and the pass unit 12 has a high input capacitance, another low-frequency pole is disposed on a connection terminal between the error amplifier 11 and the pass unit 12.

Since two poles of the low drop-out regulator 10 are disposed in a low frequency band, the poles may be disposed within a unit gain bandwidth (UGB). In other words, the low drop-out regulator 10 may be in an unstable state. To maintain stability of the low drop-out regulator 10, a buffer may be inserted between the error amplifier 11 and the pass unit 12.

Figure 2:
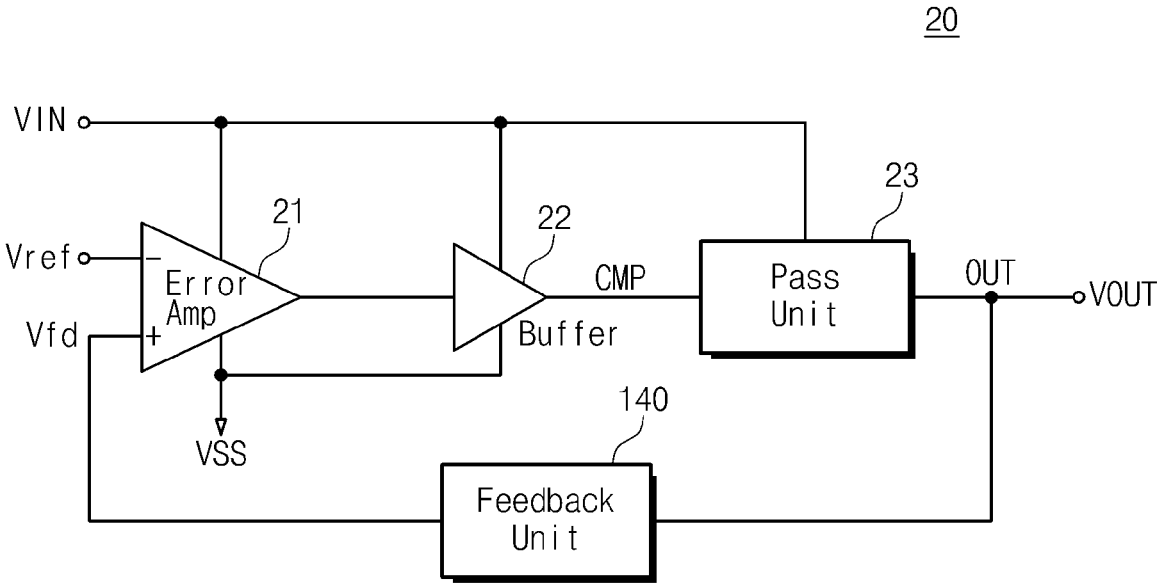
FIG. 2 is a block diagram of a low drop-out regulator comprising a buffer.

FIG. 2 is a block diagram of a low drop-out regulator comprising a buffer. Referring to FIG. 2, a low drop-out regulator 20 includes an error amplifier 21, a buffer 22, a pass unit 23, and a feedback unit 24. The error amplifier 21, the pass unit 23, and the feedback unit 24 of FIG. 2 may have the same constitution and principle as those of the error amplifier 11, the pass unit 12, and the feedback unit 13 of FIG. 1.

The buffer 22 has a low input capacitance and low output resistance. Thus, the buffer 22 may split a low-frequency pole of a connection terminal, between the error amplifier 21 and the pass unit 23, into two high-frequency poles.

However, one of or both of the split high-frequency poles may be disposed within the UGB. To compensate the poles, a low-frequency LPH zero may be inserted into the low drop-out regulator 20.

Even though the low-frequency LPH zero is inserted, the stability of the low drop-out regulator may be changed according to the intensity of current flowing into an output terminal OUT of the low drop-out regulator 20, i.e., load current.

The load current may be varied in response to a comparison signal provided to the pass unit 23. The intensity of a load resistance of the output terminal OUT may be varied in response to the intensity of the load current. A frequency of a dominant pole, generated in the output terminal OUT, is changed in response to the intensity of the load resistance. When the frequency of the dominant pole is changed, loop stability of the low drop-out regulator 20 may be reduced. Hereinafter, this will be described in more detail with reference to FIGS. 3 and 4.

Figure 3:
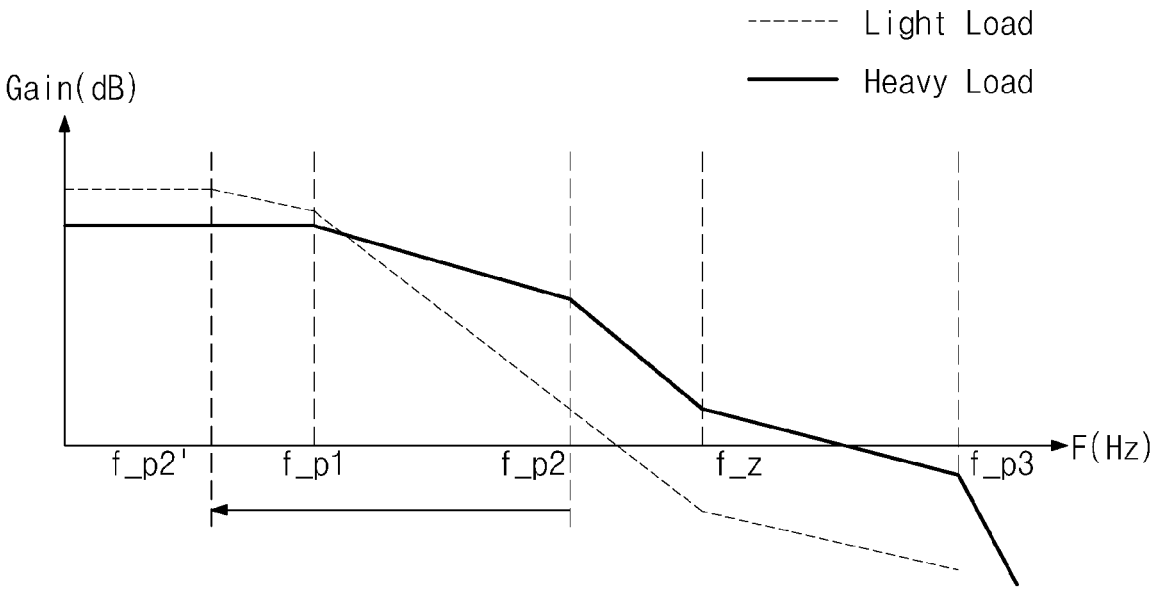
FIG. 3 is a graph of a bode plot in heavy and light load conditions of a 2-pole low drop-out regulator.

FIG. 3 is a graph of a bode plot in heavy and light load conditions of a 2-pole low drop-out regulator. In FIG. 3, a horizontal axis represents a frequency, and a vertical axis represents a gain.

In a heavy load condition, since all of two poles f_p1 and f_p2 and one inserted zero f_z exist within a UGB, the low drop-out regulator may be stable.

When load current is reduced, a pole f_p2' of an output terminal OUT responds to the load current by moving to a low frequency. Thus, in a light load condition, since the two poles f_p1 and f_p2' are disposed within the UGB, but the zero f_z does not exist within the UGB even though the zero f_z is inserted, the low drop-out regulator may be in an unstable state. To prevent the unstable state, the low drop-out regulator may change a zero frequency in response to the load current.

Figure 4:
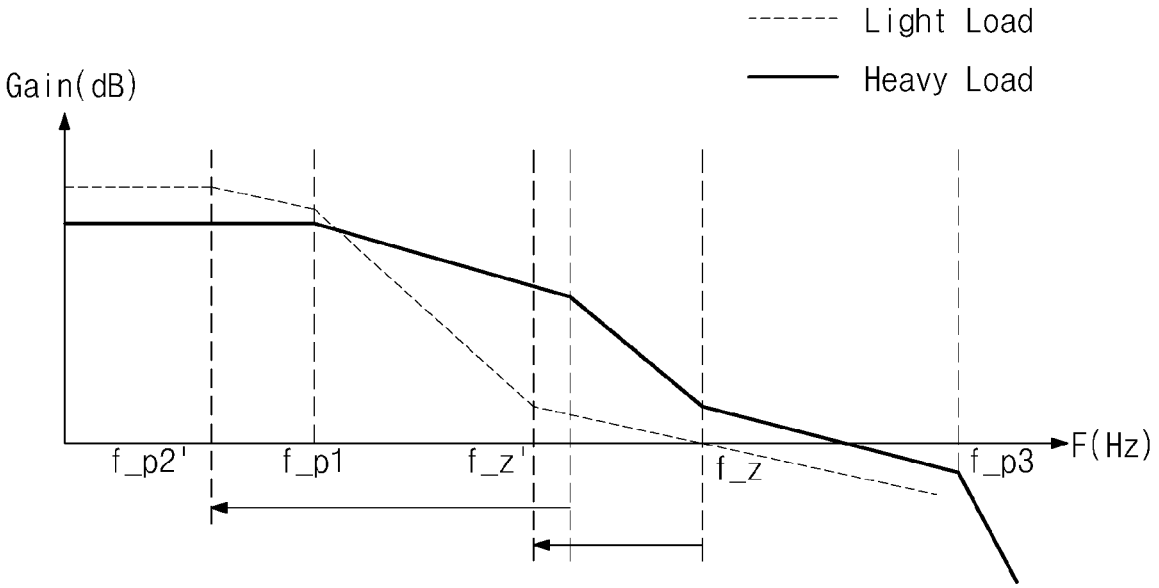
FIG. 4 is a graph of a bode plot in heavy and light load conditions of a 2-pole low drop-out regulator in which a zero frequency is varied.

FIG. 4 is a graph of a bode plot in light and heavy load conditions of a 2-pole low drop-out regulator in which a zero frequency is changed. In FIG. 4, a horizontal axis represents a frequency, and a vertical axis represents a gain.

Unlike the low drop-out regulator having the characteristics described with reference to FIG. 3, the low drop-out regulator of FIG. 4 has a zero frequency changed when a pole frequency is changed. That is, when a pole f_p2' of an output terminal OUT moves to a low frequency in a light load condition, an inserted zero f_z' may also move to the low frequency. In FIG. 4, since all of the two poles f_p1 and f_p2' and the one inserted zero f_z' exist within the UGB in the light load condition, the low drop-out regulator may be stable.

However, unlike the 2-pole low drop-out regulator having the characteristics described with reference to FIG. 4, the low drop-out regulator 20 in which the buffer of FIG. 2 is inserted may have three poles. One high-frequency pole always exists at a frequency greater than the UGB, such that the low drop-out regulator 20 has the same frequency characteristic as the bode plot of FIG. 3.

To dispose the high-frequency pole at a high frequency, driving current of the buffer (see reference numeral 22 of FIG. 2) may increase. However, if the driving current of the buffer 22 increases, power efficiency of the low drop-out regulator 20 may be reduced.

Figure 5:
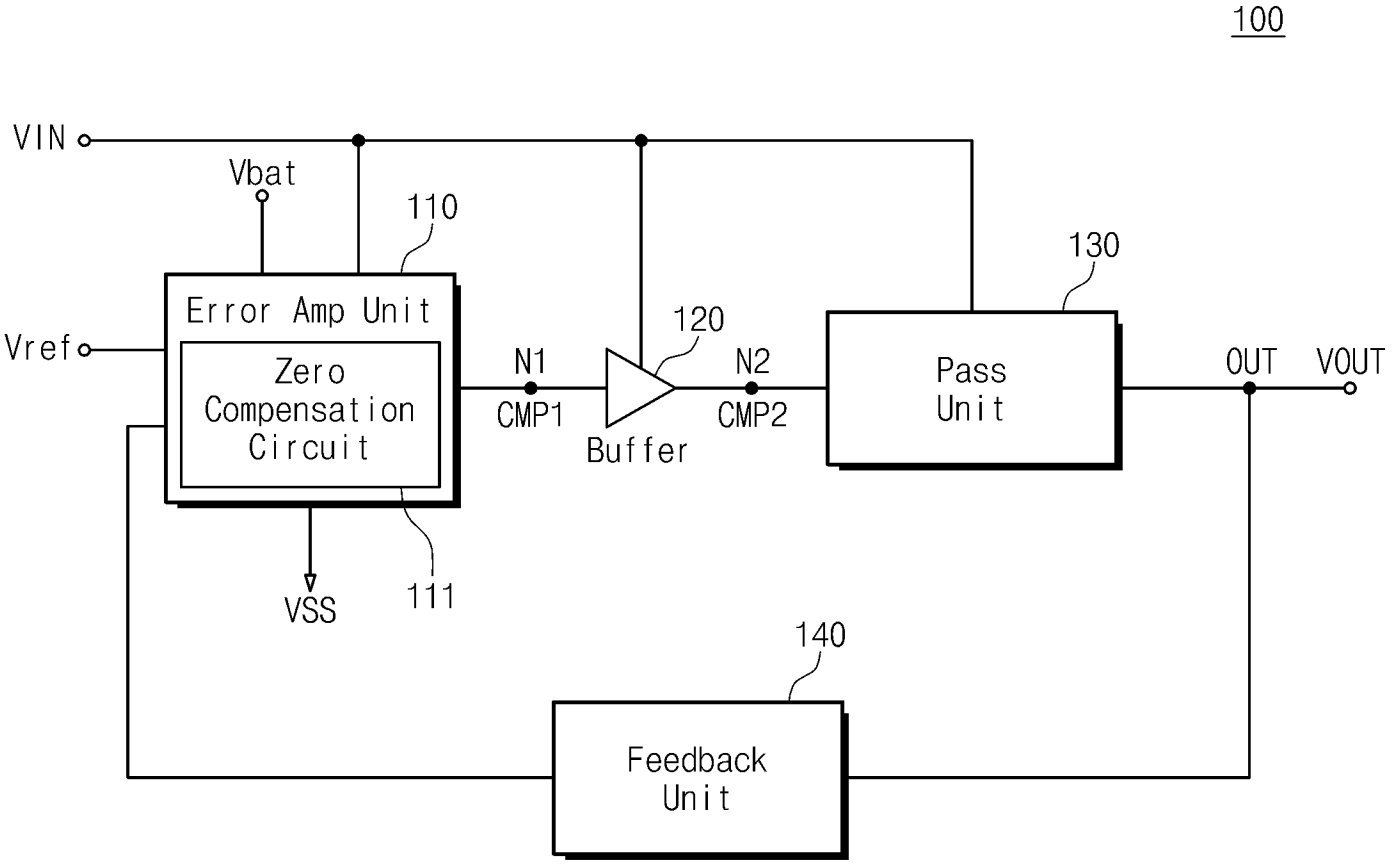
FIG. 5 is a block diagram of a low drop-out regulator according to the exemplary embodiments.

FIG. 5 is a block diagram of a low drop-out regulator according to the exemplary embodiments. Referring to FIG. 5, a low drop-out regulator 100 includes an error amplification unit 110, a buffer 120, a pass unit 130, and a feedback unit 140.

The low drop-out regulator 100 includes a buffer 120 having a rail-to-rail structure that provides a wide input voltage range. The buffer 120 may be driven at a low input voltage. The driving current of the buffer 120 may be uniformly maintained, even though current provided to an output terminal OUT of the low drop-out regulator 100, i.e., load current is changed. Thus, the low drop-out regulator 100 may have uniformly maintained power efficiency. Also, the buffer 120 may constitute only a complementary metal-oxide semiconductor (CMOS). Thus, the buffer 120 may have a relatively small area when compared to that using a bipolar junction transistor (BJT).

Also, the low drop-out regulator 100 includes a zero compensation circuit 111 to provide a stable frequency response characteristic. The error amplification unit 110 of the low drop-out regulator 100 includes the zero compensation circuit 111 for inserting a second compensation zero. The zero compensation circuit 111 prevents a pole of an output terminal OUT from being changed, in response to load current of the low drop-out regulator 100 from meeting poles being generated at both ends of the buffer 120. When the load current of the low drop-out regulator from meeting poles are generated at both ends of the buffer 120, a complex-pole is generated. The low drop-out regulator 100 may maintain stable driving current by using the zero compensation circuit 111 when the driving current of the buffer 120 is fixed, even though the load current is changed.

The error amplification unit 110 compares a reference voltage Vref to a feedback voltage Vfd. The error amplification unit 110 responds to the comparison result to generate a first comparison signal CMP1 and provides the generated first comparison signal CMP1 to the buffer 120. The first comparison signal CMP1 includes information with respect to a change in an output voltage VOUT of the low drop-out regulator 100.

The reference voltage Vref may be provided from a reference voltage generation unit which is connected outside of the low drop-out regulator 100. The output voltage VOUT of the low drop-out regulator 100 may be determined on the basis of the reference voltage Vref. The error amplification unit 110 receives a battery voltage Vbat, an input voltage VIN, and a source voltage VSS as a bias voltage. The battery voltage Vbat, the input voltage VIN, and the source voltage VSS may be provided from a reference voltage generation unit which is connected outside of the low drop-out regulator 100.

The error amplification unit 110 may insert the second compensation zero into the low drop-out regulator 100 using the zero compensation circuit 111. The second compensation zero inserted by the zero compensation circuit 111 of the error amplification unit 110 may compensate the pole of low drop-out regulator 100. The error amplification unit 110 and the zero compensation circuit 111 will be described in more detail with reference to FIGS. 7 and 8.

The buffer 120 responds to the first comparison signal CMP1 and the input voltage VIN by generating a second comparison signal CMP2 and providing the generated second comparison signal CMP2 to a pass unit.

Since the buffer 120 has a low input capacitance, the buffer 120 may dispose a pole of a node N1 in a high frequency band, in spite of high output resistance of the error amplification unit 110. Since the buffer 120 has low output resistance, the buffer 120 may dispose a pole of a node N2 in the high frequency band, in spite of a high input capacitance of the pass unit 130.

The buffer 120 may have a rail-to-rail structure. The buffer 120 may have a wide input/output range by using the rail-to-rail structure. The buffer 120 may be driven at the low input voltage VIN by using the rail-to-rail structure.

The driving current of the buffer 120 may be uniformly maintained even though the load current of the low drop-out regulator 100 is changed. When the driving current of the buffer 120 is fixed, poles generated at the input/output terminals N1 and N2 of the buffer 120 may be fixed, even though the load current of the low drop-out regulator 100 is changed.

When the poles generated at the input/output terminals N1 and N2 of the buffer 120 are fixed, a pole of an output terminal OUT of the low drop-out regulator 100 and a pole generated at the output node N2 of the buffer may approach each other. As described above, the zero compensation circuit 111 of the error amplification unit 110 may insert the second compensation zero to prevent the complex-pole from being generated due to the approach of the two poles.

The pass unit 130 responds to the second comparison signal CMP2 and the input voltage VIN by providing an output voltage VOUT to the output terminal OUT of the low drop-out regulator 100. The pass unit 130 may respond to the second comparison signal CMP2 and the input voltage VIN by controlling the intensity of current provided to the output terminal OUT.

The feedback unit 140 responds to the output voltage VOUT by generating a feedback voltage Vfd. The feedback voltage Vfd may be a voltage in which the output voltage VOUT is distributed at a predetermined ratio. The feedback unit 140 provides the generated feedback voltage Vfd to the error amplification unit 110.

Also, the feedback unit 140 may provide a first compensation zero to the low drop-out regulator 100. As shown in FIGS. 3 and 4, the first compensation zero may compensate the pole of the low drop-out regulator 100 by disposing the two poles and one zero within a UGB.

Since the above-described low drop-out regulator 100 has a high input/output voltage range by using the buffer 120, the low drop-out regulator 100 may be driven at a low input voltage. The low drop-out regulator 100 may insert the first compensation zero to compensate the pole of the low drop-out regulator 100 within the UGB.

The driving current of the buffer 120 may be uniformly maintained, even though the load current of the low drop-out regulator 100 is changed. The low drop-out regulator 100 may insert the second compensation zero to maintain stability, even though the driving current of the buffer 120 is fixed.

The buffer 120 of the low drop-out regulator 100 may constitute only a complementary metal-oxide semiconductor (CMOS). Thus, the buffer 120 may have a relatively small area, when compared to that using a bipolar junction transistor (BJT).

Figure 6:
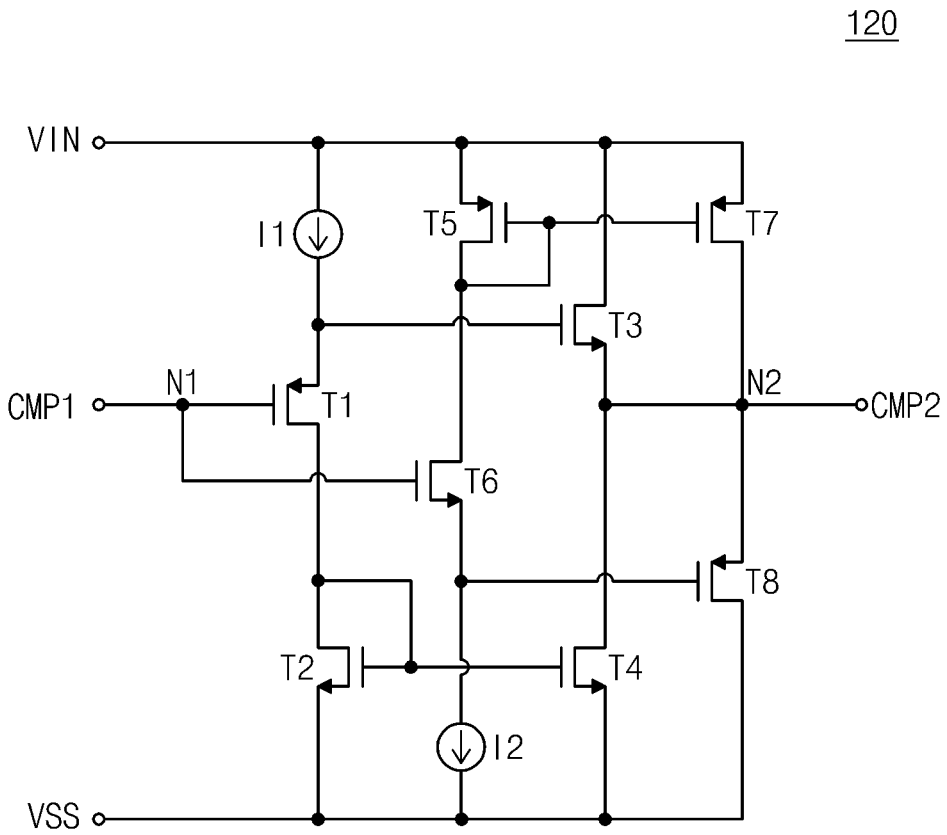
FIG. 6 is an exemplary embodiment of a detailed circuit diagram illustrating a buffer of FIG. 5.

FIG. 6 is an exemplary detailed circuit diagram illustrating the buffer of FIG. 5. Referring to FIG. 6, the buffer 120 includes a light load unit and a heavy load unit.

The heavy load unit includes a first current source I1 and first to fourth transistors T1 to T4. The heavy load unit is turned on when the low drop-out regulator (see reference numeral 100 of FIG. 5) is in a heavy load condition, i.e., each of the node N1 and node N2 has a low voltage. When the low drop-out regulator 100 is in a heavy load condition, the heavy load unit buffers the first comparison signal CMP1 input to the node N1 to provide the buffered comparison signal to the node N2 as the second comparison signal CMP2. The first transistor T1 may be a PMOS transistor. Each of the second to fourth transistors T2 to T4 may be an NMOS transistor.

The light load unit includes a second current source 12 and fifth to eighth transistors T5 to T8. The light load unit is turned on when the low drop-out regulator 100 is in a light load condition, i.e., each of the node N1 and node N2 has a high voltage. When the low drop-out regulator 100 is in the light load condition, the light load unit buffers the first comparison signal CMP1 input to the node N1 to provide the buffered comparison signal to the node N2 as the second comparison signal CMP2. The sixth transistor T6 may be an NMOS transistor. Each of the fifth, seventh, and eighth transistors T5, T7, and T8 may be a PMOS transistor.

When the node N1 is in a low voltage condition, the first transistor T1 of the heavy load unit is turned on, and the sixth transistor T6 of the light load unit is turned off.

When the first transistor T1 is turned on, the first comparison signal CMP1 input to the node N1 is provided to a gate of the third transistor T3 via a gate-source of the first transistor T1. In other words, the first transistor T1 may operate as a source-follower.

Since the second and fourth transistors T2 and T4 operate as a current mirror in response to the turn-on of the first transistor T1, the third transistor T3 is turned on. When the third transistor T3 is turned on, the first comparison signal CMP1 provided to the gate of the third transistor T3 is provided to the output node N2 via a gate-source of the third transistor T3. In other words, the third transistor T3 may operate as the source-follower.

When the low drop-out regulator 100 is in the light load condition, the above-described buffer 120 may output the first and second comparison signals CMP1 and CMP2 using the light load unit. Since the minimum input voltage VIN required for driving the light load unit is a minimum voltage for turning all of the first to fourth transistors T1 to T4 on, the buffer 120 may have a minimum input voltage which is less than a circuit using the BJT.

When the node N1 is in a high voltage condition, the light load unit is turned off, and the heavy load unit is turned on. In other words, the first transistor T1 connected to the node N1 is turned off, and the sixth transistor T6 is turned on.

When the sixth transistor T6 is turned on, the first comparison signal CMP1 input to the node N1 is provided to a gate of the eighth transistor T8 via a gate-source of the sixth transistor T6. In other words, the sixth transistor T6 may operate as a source-follower.

Since the fifth and seventh transistors T5 and T7 operate as a current mirror in response to the turn-on of the sixth transistor T6, the eighth transistor T8 is turned on. When the eighth transistor T8 is turned on, the first comparison signal CMP1 provided to a gate of the eighth transistor T8 is provided to the output node N2 via a gate-source of the eighth transistor T8. In other words, the eighth transistor T8 may operate as a source-follower.

When the low drop-out regulator 100 is in the heavy load condition, the above-described buffer 120 may output the first and second comparison signals CMP1 and CMP2 using the heavy load unit. Since the minimum input voltage VIN required for driving the heavy load unit is a minimum voltage for turning all of the fifth to eighth transistors T5 to T8 on, the buffer 120 may have a minimum input voltage which is less than that of the circuit using the BJT.

In the light load condition, the intensity of the driving current flowing into the output terminal N2 of the buffer 120 may be determined on the basis of the first current source I1. In the heavy load condition, the intensity of the driving current flowing into the output terminal N2 of the buffer 120 may be determined on the basis of the second current source 12. In other words, the intensity of the driving current flowing into the output terminal N2 of the buffer 120 is not changed, even though the load current of the low drop-out regulator 100 is changed.

If the load current increases, since the buffer 120 is driven by the fixed driving current, power consumption does not increase. However, when the driving current of the buffer 120 is fixed, a frequency of the pole of the output terminal N2 of the buffer 120 is fixed. Thus, if the load current is changed, the complex-pole may be generated at a position approaching the pole generated by the output terminal OUT of the low drop-out regulator 100. Hereinafter, the error amplification unit for preventing the above-described limitation will be described with reference to the accompanying drawings.

Figure 7:
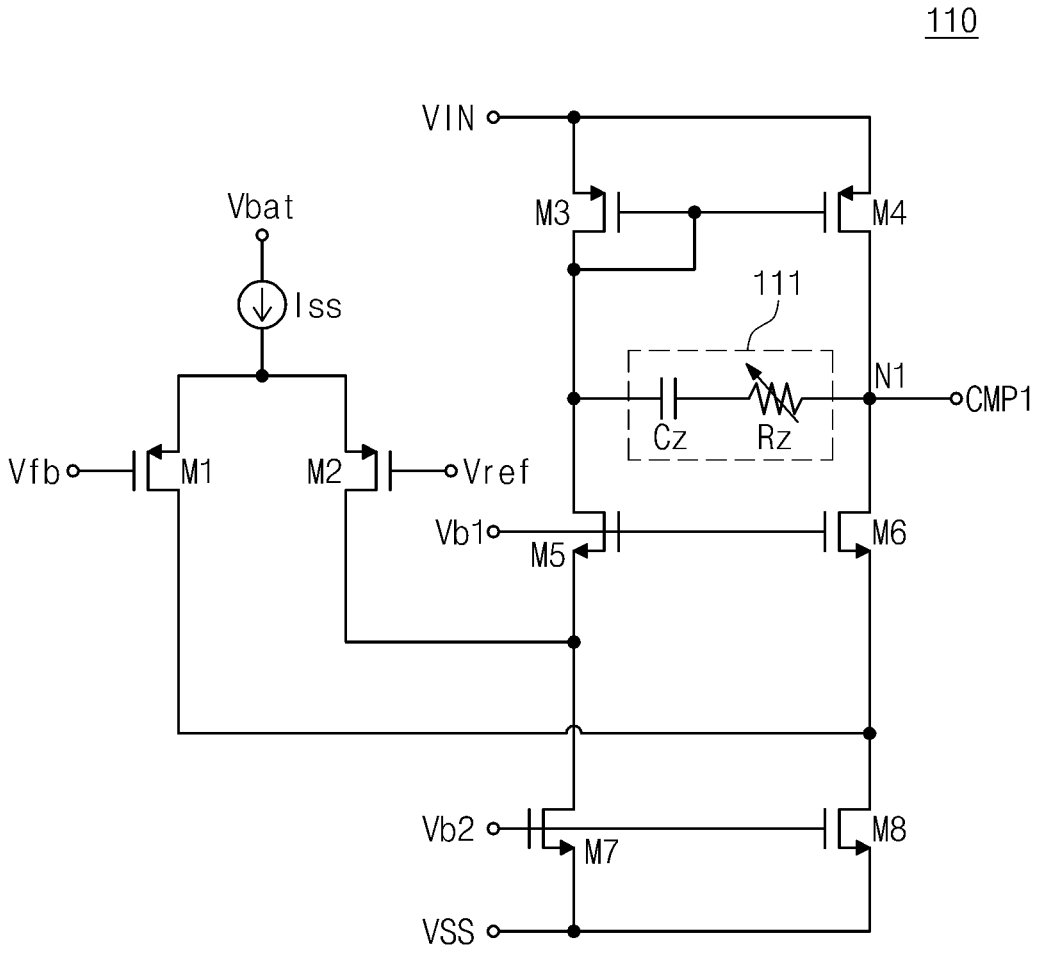
FIG. 7 is an exemplary embodiment of a detailed circuit diagram illustrating an error amplification unit of FIG. 5.

FIG. 7 is a circuit diagram of an error amplification unit according to an exemplary embodiment. Referring to FIG. 7, an error amplification unit 110 includes a zero compensation circuit 111. The error amplification unit 110 may insert the second compensation zero in the low drop-out regulator (see reference numeral 100 of FIG. 5) using the zero compensation circuit 111. The second compensation zero, inserted by the error amplification unit 110, may compensate a complex-pole.

The error amplification unit 110 may have a differential amplifier structure. The error amplification unit 110 compares a reference voltage Vref to a feedback voltage Vfd. The error amplification unit 110 responds to the comparison result by generating a comparison signal CMP1 and providing the generated comparison signal CMP1 to a buffer 120.

A first transistor M1 and a second transistor M2 constitute an input stage of the error amplification unit. Each of the first and second transistors M1 and M2 may be a PMOS transistor.

A feedback voltage Vfd is input to a gate of the first transistor M1. A reference voltage VreF is input to a gate of the second transistor M2. Sources of the first and second transistors M1 and M2 are connected to a current source Iss to receive a bias current. Drains of the first and second transistors M1 and M2 are connected to a transistor M5 and a source of a transistor M6, respectively.

Each of third to eighth transistors M3 to M8 has a folded cascade structure to constitute an output stage of the error amplification unit 110. The third to sixth transistors M3 to M6 constitute an active load of the output stage. Each of the third and fourth transistors M3 and M4 may be a PMOS transistor. Each of fifth to eighth transistors M5 to M8 may be an NMOS transistor.

An input voltage VIN is provided to a source of each of the third and fourth transistors M3 and M4. Gates of the third and fourth transistors M3 and M4 are connected to each other, and the gate of the third transistor M3 is connected to a drain of the third transistor M3. In other words, the third and fourth transistors M3 and M4 constitute a current mirror.

Drains of the fifth and sixth transistors M5 and M6 are connected to drains of the third and fourth transistors M3 and M4, respectively. Drains of the seventh and eighth transistors M7 and M8 are connected to sources of the fifth and sixth transistors M5 and M6, respectively. A source voltage VSS is provided to source of each of the seventh and eighth transistors M7 and M8.

A first bias voltage Vb1 for turning the fifth and sixth transistors M5 and M6 on is provided to each of gates of the fifth and sixth transistors M5 and M6. A second bias voltage Vb2 for turning the seventh and eighth transistors M7 and M8 on is provided to each of gates of the seventh and eighth transistors M7 and M8.

A first comparison signal CMP1 is output from a connection node N1 between the drain of the fourth transistor M4 and the drain of the sixth transistor M6, in response to the reference voltage Vref and the feedback voltage Vfd. In other words, the above-described error amplification unit 110 responds to a difference between the intensities of the feedback voltage Vfd and the reference voltage Vref by outputting the amplified intensity difference as the first comparison signal CMP1.

As described above, the error amplification unit 110 includes a zero compensation circuit 111. The zero compensation circuit 111 includes a compensation capacitor Cz and a compensation variable resistor Rz connected in series to the compensation capacitor Cz. The zero compensation circuit 111 is connected between a connection terminal of the third and fifth transistors M3 and M5 and the node N1.

The zero compensation circuit 111 may provide a second compensation zero using the compensation variable resistor Rz connected in series to the compensation capacitor Cz of the output terminal. The second compensation zero may be an equivalent series resistor (ESR) zero. A first compensation zero provided by the zero compensation circuit 111 may have a frequency of 1/CzRz.

Since a pole generated at the output terminal OUT of the low drop-out regulator 100 is changed in response to the load current, for compensating the change of the pole, the second compensation zero should also be changed in response to the load current.

Resistance of the compensation variable resistor Rz of the zero compensation circuit 111 is variable in response to the load current. More particularly, resistance of the compensation variable resistor Rz may have a high value under the light load condition and a low value under the heavy load condition. The second compensation zero may be disposed in a low frequency under the light load condition and a high frequency under the heavy load condition, in response to resistance of the compensation variable resistor Rz.

The error amplification unit 110 prevents a pole of the output terminal OUT, changed in response to the load current of the low drop-out regulator 100, from meeting poles generated at both ends of the buffer 120 to generate a complex-pole using the zero compensation circuit 111. Although the error amplification unit 110 of FIG. 7 has a single stage folded-cascode structure, the present disclosure is not limited.

Figure 8:
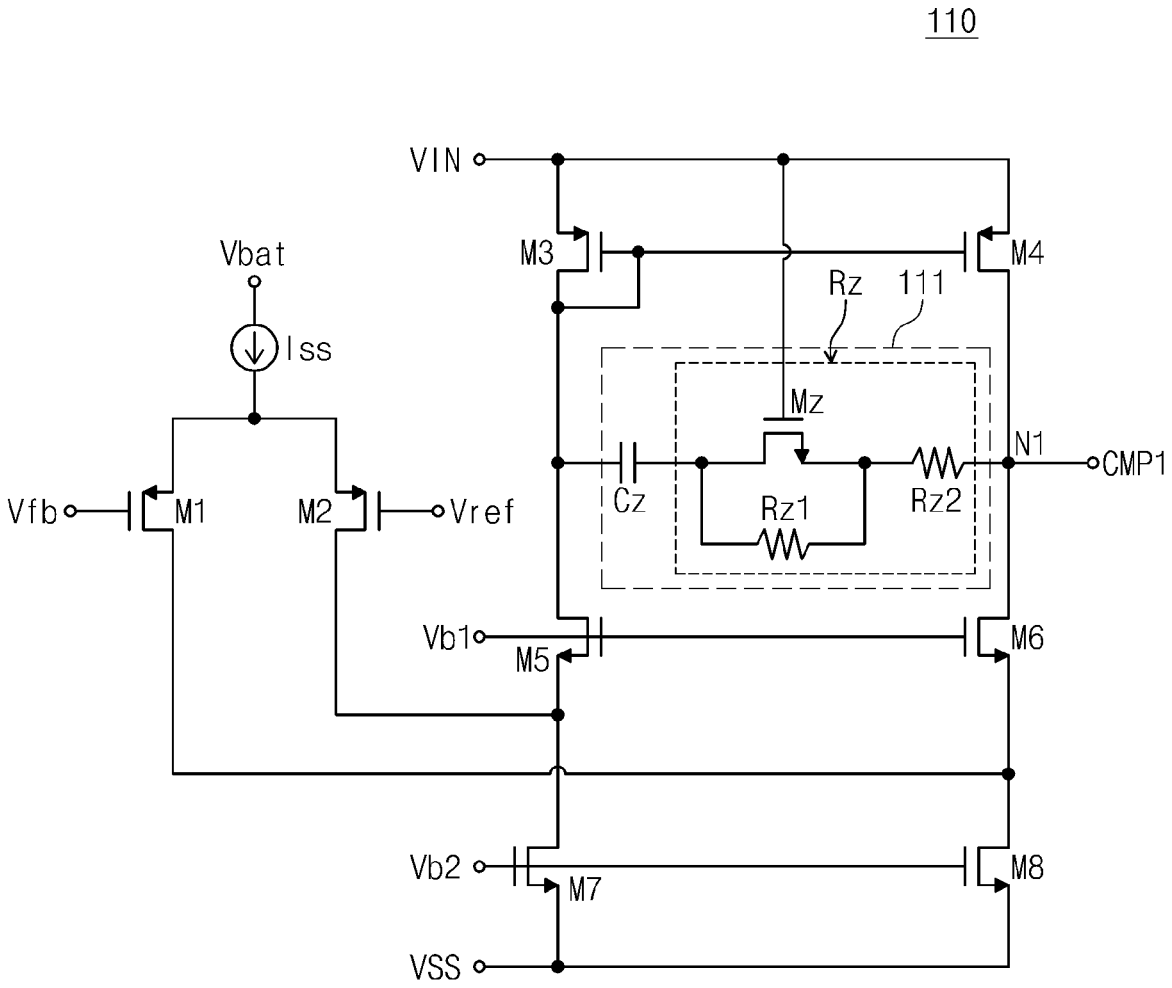
FIG. 8 is a circuit diagram of the error amplification unit of FIG. 7 in which a zero compensation circuit is applied according to an exemplary embodiment.

FIG. 8 is a circuit diagram of the error amplification unit of FIG. 7 in which a zero compensation circuit is applied according to an exemplary embodiment. The components M1 to M8 and Iss of the error amplification unit of FIG. 8, except for a zero compensation circuit 111, may have the same operation principle and configuration the error amplification unit of FIG. 7.

The zero compensation circuit 111 includes a compensation capacitor Cz and a compensation variable resistor Rz (see FIG. 6). The compensation variable resistor Rz includes a first compensation variable resistor Rz1, a second compensation variable resistor Rz2, and a compensation transistor Mz. The compensation transistor Mz may be an NMOS transistor.

An input voltage VIN is provided to a gate of the compensation transistor Mz. The first compensation resistor Rz1 has both ends connected to a source and drain of the compensation transistor Mz. One end of the first compensation resistor Rz1 and the drain of the compensation transistor Mz is connected to a compensation capacitor Cz, and the other end of the first compensation resistor Rz1 and the source of the compensation transistor Mz is connected to one end of the second compensation resistor Rz2. The other end of the second compensation resistor Rz2 is connected to an output node N1 of the error amplification unit 110.

As described with reference to FIG. 5, under the light load condition, the output node N1 of the error amplification unit 110 has a high voltage level. When a voltage level of the output node N1 increases to approach a level of the input voltage VIN, the compensation transistor Mz is turned off. When the compensation transistor Mz is turned off, the intensity of the resistance of the compensation variable resistor Rz is equal to the sum of the intensities of the resistance of the first compensation resistor Rz1 and the resistance of the second compensation resistor Rz2.

Under the heavy load condition, the output node N1 of the error amplification unit 110 has a low voltage level. When a voltage level of the output node N1 decreases by a predetermined level in comparison to the input voltage VIN, the compensation transistor Mz is turned on. When the compensation transistor Mz is turned on, a resistance of the first compensation variable resistor Rz1 has the same intensity as a resistance of the second compensation resistor Rz2.

As described above, a resistance of the compensation variable resistor Rz may have a high value under the light load condition, and a low value under the heavy load condition. The second compensation zero may be disposed in a low frequency under the light load condition and a high frequency under the heavy load condition, in response to the resistance of the compensation variable resistor Rz compensating a pole of an output terminal OUT of the low drop-out regulator (see reference numeral 100 of FIG. 2).

Figure 9:
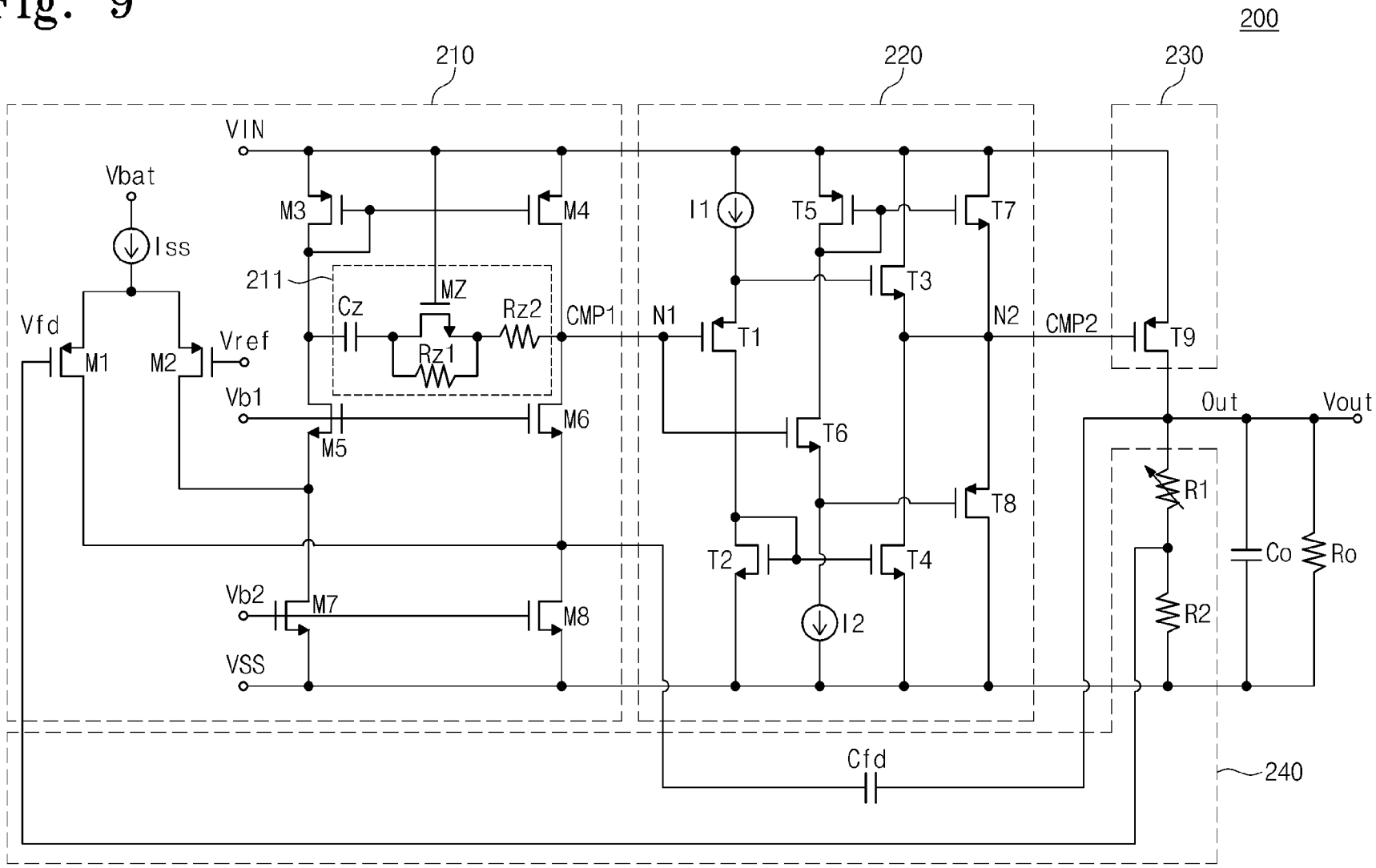
FIG. 9 is a circuit diagram of a low drop-out regulator according to an exemplary embodiment.

FIG. 9 is a circuit diagram of a low drop-out regulator according to an exemplary embodiment. Referring to FIG. 9, a low drop-out regulator 200 includes an error amplification unit 210, a buffer 220, a pass unit 230, and a feedback unit 240. The error amplification unit 210 of FIG. 9 may have the same operation principle and configuration as the error amplification unit 110 of FIG. 8. The buffer 220 of FIG. 9 may have the same operation principle and configuration as the buffer 120 of FIG. 6.

The error amplification unit 210 compares a reference voltage Vref to a feedback voltage Vfd. The error amplification unit 210 responds to the comparison result by generating a first comparison signal CMP1 and provides the generated comparison signal CMP1 to the buffer 220. The first comparison signal CMP1 includes information with respect to a change in an output voltage VOUT of the low drop-out regulator 200.

The error amplification unit 210 includes a zero compensation circuit 211. The error amplification unit 210 may insert a second compensation zero into the low drop-out regulator 200 by using the zero compensation circuit 211. The second compensation zero inserted by the zero compensation circuit 211 of the error amplification unit 210 may compensate a complex-pole.

The buffer 220 responds to the first comparison signal CMP1 and the input voltage VIN by generating a second comparison signal CMP2 and providing the generated second comparison signal CMP2 to a pass unit.

The pass unit 230 responds to the second comparison signal CMP2 and the input voltage VIN by providing an output voltage VOUT to the output terminal OUT of the low drop-out regulator 200. Also, the pass unit 230 may respond to the second comparison signal CMP2 and the input voltage VIN by controlling the intensity of the current provided to the output terminal OUT.

The pass unit 230 includes a ninth transistor T9. The ninth transistor T9 may be a PMOS transistor. An input voltage VIN is provided to a source of the ninth transistor T9. A drain of the ninth transistor T9 is connected to the output terminal OUT of the low drop-out regulator 200 to provide an output voltage VOUT.

A second comparison signal CMP2 is provided to a gate of the ninth transistor T9. The ninth transistor T9 may respond to the second comparison signal CMP2 to adjust a drain-source current, thereby controlling the intensity of current provided to the output terminal OUT.

The feedback unit 240 responds to the output voltage VOUT by generating a feedback voltage Vfd. The feedback unit 240 provides the generated feedback voltage Vfd to the error amplification unit 210. The feedback unit 240 includes a first feedback resistor R1, a second feedback resistor R2, and a feedback compensation capacitor Cfd.

The first feedback resistor R1 and the second feedback resistor R2 are connected in series to the output terminal OUT. The first feedback resistor R1 may be a variable resistor. The feedback voltage Vfd is provided to a connection terminal between the first feedback resistor R1 and the second feedback resistor R2. The feedback voltage Vfd is a voltage in which the output voltage VOUT is distributed at a ratio of the resistance of the first feedback resistor R1 and the resistance of the second feedback resistor R2. The intensity of the feedback voltage Vfd may be changed in response to the intensity of the resistance of the first feedback resistor R1. The feedback voltage Vfd is provided to a gate of the first transistor M1 of the error amplification unit 210.

The feedback compensation capacitor Cfd is connected between the output terminal OUT and the error amplification unit 210. More particularly, the feedback compensation capacitor Cfd is connected to the output terminal OUT and a source of a sixth transistor M6 of the error amplification unit 210.

The feedback compensation capacitor Cfd provides a first compensation zero to the low drop-out regulator 200. The first compensation zero provided by the feedback compensation capacitor Cfd may be determined in response to the intensity of capacitance of the feedback compensation capacitor Cfd and transconductance of the sixth transistor M6. The feedback compensation capacitor Cfd may compensate a pole of the low drop-out regulator 200 by using the first compensation zero, so that two poles and one zero are disposed within a UGB.

The above-described low drop-out regulator 200 may dispose the pole in a high frequency using the buffer 220. The buffer 220 of the low drop-out regulator 200 may operate at a low input power and fixed driving current. Even though the driving current of the buffer 220 is fixed, the low drop-out regulator 200 may compensate the poles by using the first and second compensation zeros.

A DC output voltage of the low drop-out regulator 200 may be expressed as Equation 1. A start-up time of the low drop-out regulator 200 may be expressed as Equation 2, regardless of the load capacitance of the output terminal OUT.

$$VOUT = \left(1 + \frac{R1}{R2}\right)Vref \quad \text{(Equation 1)}$$

$$\frac{dV}{dt} = \frac{Iss}{Cfd} \quad \text{(Equation 2)}$$

Hereinafter, a zero and pole of the low drop-out regulator 200 will be described with reference to FIG. 10.

Figure 10:
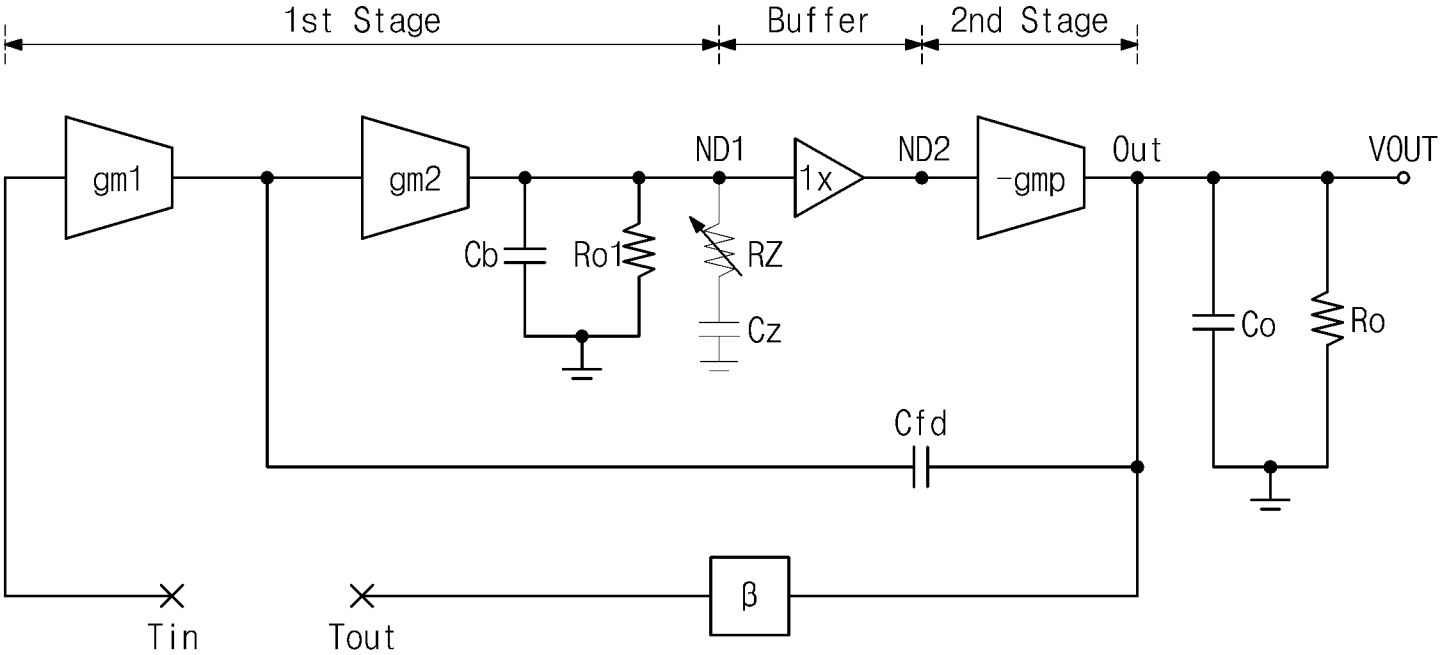
FIG. 10 is a small-signal block diagram of the low drop-out regulator of FIG. 9.

FIG. 10 is a small-signal block diagram of the low drop-out regulator of FIG. 9.

A first stage represents an error amplification unit (see reference numeral 210 of FIG. 9). A first transconductance block gm1 represents a transconductance of input stage transistors M1 and M2 of the error amplification unit 210. A second transconductance block gm2 represents a transconductance of a sixth transistor M6 of the error amplification unit 210.

A buffer capacitance Cb is an input capacitance of a buffer when viewed from a node N1. The first output resistor Ro1 is an output resistor of the error amplification unit 210, when viewed from the node N1.

A second stage represents a pass unit (see reference numeral 230 of FIG. 9). A pass transconductance block-gmp represents a transconductance of a ninth transistor M9 of the pass unit 210. A load capacitance Co and a load resistor Ro represent a load capacitance and a load resistor of an output terminal OUT of the low drop-out regulator 200.

A feedback block β represents a return rate of the low drop-out regulator 200. Referring to FIG. 9, a return rate of the low drop-out regulator 200 may be expressed as:

$$R2/(R1+R2)$$

As described, the low drop-out regulator 200 has three poles and two zeros. The three poles are disposed at an input node N1 of a buffer, an output node N2 of the buffer, and an output terminal OUT of the low drop-out regulator, respectively. A first compensation zero z1 of the two zeros is provided by a feedback compensation capacitor Cfd. The second compensation zero z2 is provided by a compensation variable resistor Rz and a compensation capacitor Cz. Frequencies fz1 and fz2 of the compensation zeros may be expressed as the following Equations 3 and 4:

$$fz1 = \frac{cfd}{gm2} \quad \text{(Equation 3)}$$

$$fz2 = \frac{1}{RzCz} \quad \text{(Equation 4)}$$

In a light load condition, frequencies fp1, fp2, and fp3 of three poles p1, p2, and p3 may be expressed as the following Equation 5:

$$fp1 = \frac{1}{RoCo}, \quad fp2 = \frac{1}{Ro1Cb}, \quad fp3 = \frac{Cfd}{gm2} \quad \text{(Equation 5)}$$

The third pole p3 is compensated by the first compensation zero z1. In the light load condition, a dominant pole may be the first pole p1 generated at the output terminal OUT. Since the input capacitance Cb of the buffer is low, the second pole p2, which is a non-dominant pole, may be disposed at a position higher than the unit gain bandwidth (UGB). Thus, the low drop-out regulator 200 may be maintained at a stable state.

In a heavy load condition, frequencies fp1, fp2, and fp3 of three poles p1, p2, and p3 may be expressed as the following Equation 6:

$$fp1 = \frac{(gmp)Cfd}{CbCo}, \quad fp2 = \frac{1}{(gmp)CfdRo1Ro}, \quad fp3 = \frac{Cfd}{gm2} \quad \text{(Equation 6)}$$

The third pole p3 is compensated by the first compensation zero z1. In the heavy load condition, a dominant pole may be the second pole p2 generated at a node N1.

In the heavy load condition, to prevent generation of a complex-pole due to an increase of a frequency of the first pole p1 generated at the output terminal OUT, the first pole p1 may be compensated by the second compensation zero z2.

The above-described low drop-out regulator 200 may dispose the pole in a high frequency using the buffer 220. The buffer 220 of the low drop-out regulator 200 may operate at a low input power and fixed driving current. Even though the driving current of the buffer 220 is fixed, the low drop-out regulator 200 may compensate the poles using the first and second compensation zeros to prevent the complex-pole from being generated.

The low drop-out regulator according to the exemplary embodiments may have the wide input voltage range and stable frequency response characteristic.

Although specific embodiments are described in the detailed description of the exemplary embodiments, the detailed description may be amended or modified without being out of the scope of the exemplary embodiments. For example, the detailed constitutions of the error amplification unit, the buffer, the pass unit, and the feedback unit may be variously changed or modified according to specific environments or use. In the following description, the technical terms are used only for explaining a specific exemplary embodiment, while not limiting the scope of the exemplary embodiments. In other words, it is intended that the present disclosure covers the modifications and variations of the exemplary embodiments, provided they come within the scope of the appended claims and their equivalents.

What is claimed is:

1. A low drop-out regulator comprising:

an error amplification unit which comprises a zero compensation circuit configured to compensate a plurality of poles which are generated by an output terminal and a buffer, the error amplification unit is configured to generate a first comparison signal in response to a reference voltage and a feedback voltage;

the buffer is configured to generate a second comparison signal in response to the first comparison signal and an input voltage;

a pass unit configured to provide an output voltage and a load current to the output terminal in response to the second comparison signal and the input voltage; and a feedback unit configured to provide the feedback voltage to the error amplification unit in response to the output voltage, wherein a driving current of the buffer is uniformly maintained.

2. The low drop-out regulator of claim 1, wherein the buffer comprises a rail-to-rail circuit.

3. The low drop-out regulator of claim 2, wherein the rail-to-rail circuit is a CMOS device.

4. The low drop-out regulator of claim 2, wherein the rail-to-rail circuit comprises:

a heavy load unit configured to turn on in a moderate load condition and a heavy load condition in response to the first comparison signal and generate the second comparison signal, and turn off in a light load condition; and a light load unit which is connected in parallel to the heavy load unit, the light load unit configured to turn on in the moderate load condition and the light load condition in response to the first comparison signal and generate the second comparison signal, and turn off in the heavy load condition.

5. The low drop-out regulator of claim 4, wherein the heavy load unit comprises:

an input source-follower configured to turn on in the moderate load condition and the heavy load condition and transmit the first comparison signal to an intermediate node;

an output source-follower configured to output the first comparison signal, provided from the intermediate node, as the second comparison signal; and a current mirror configured to turn on in the moderate load condition and the heavy load condition and provide the driving current to the input source-follower and the output source-follower.

6. The low drop-out regulator of claim 4, wherein the light load unit comprises:

an input source-follower configured to turn on in the moderate load condition and the light load condition and transmit the first comparison signal to an intermediate node;

an output source-follower configured to output the first comparison signal, provided from the intermediate node, as the second comparison signal; and a current mirror configured to turn on in the moderate load condition and the light load condition and provide the driving current to the input source-follower and the output source-follower.

7. The low drop-out regulator of claim 1, wherein the zero compensation circuit comprises:

a compensation capacitor; and a compensation variable resistor configured to vary resistance in response to the load current.

8. The low drop-out regulator of claim 7, wherein the compensation variable resistor comprises:

a first compensation resistor;

a second compensation resistor which is connected in series to the first compensation resistor; and a compensation transistor which is connected in parallel to the first compensation resistor to form a current channel, wherein the current channel is connected in series to the second compensation resistor.

9. The low drop-out regulator of claim 8, wherein the compensation transistor is configured to have a large resistance state in the light load condition, and the compensation variable resistor comprises the first compensation resistor and the second compensation resistor connected to each other in series in response to the resistance state of the compensation transistor.

10. The low drop-out regulator of claim 8, wherein the compensation transistor is configured to have a small resistance state in the heavy load condition, and the compensation variable resistor comprises the first compensation resistor in response to the resistance state of the compensation transistor.

11. The low drop-out regulator of claim 1, wherein the feedback unit comprises:

a first feedback resistor which is connected between the output terminal and a feedback node; and a second feedback resistor which is connected between the feedback node and a ground node, wherein the feedback voltage is provided from the feedback node.

12. The low drop-out regulator of claim 11, wherein the feedback unit further comprises a feedback compensation capacitor configured to compensate the poles, and the feedback compensation capacitor is connected between the output terminal and the error amplification unit.

13. An error amplification unit used in a low drop-out regulator, the error amplification unit comprising:

an input stage configured to receive a first signal and a second signal;

an output stage which is connected to the input stage, the output stage is configured to provide a comparison signal to an output terminal in response to a difference between the first signal and the second signal; and a zero compensation circuit which is connected to the output terminal and is configured to provide a compensation zero to the error amplification unit, wherein a frequency of the compensation zero varies in response to a voltage of the output terminal, wherein the zero compensation circuit comprises:

a compensation capacitor; and a compensation variable resistor configured to vary resistance in response to the voltage of the output terminal and the compensation variable resistor comprising:

a first compensation resistor;

a second compensation resistor which is connected in series to the first compensation resistor; and a compensation transistor which is connected in parallel to the first compensation resistor to form a current channel, wherein the compensation transistor is configured to turn on or off in response to the voltage of the output terminal.

14. A method of a low drop-out regulator, the method comprising: receiving a reference voltage, a feedback voltage, and an input voltage; generating a first comparison signal in response to the reference voltage and the feedback voltage; generating a second comparison signal in response to the first comparison signal and the input voltage; generating an output voltage and a load current to an output terminal in response to the second comparison signal and the input voltage; and generating a feedback voltage in response to the output voltage, wherein a driving current of a buffer is uniformly maintained.

15. The method of claim 14, further comprising:

compensating a plurality of poles which are generated by the low-drop out regulator.

16. The method of claim 15, wherein the compensating the plurality of poles which are generated by the low-drop out regulator comprises generating a compensation LHP zero.

17. The method of claim 16, wherein a frequency of the compensation LHP zero varies in response to the voltage of the output terminal.

18. The method of claim 14, wherein the plurality of poles comprises:

a first pole at the output terminal;

a second pole between an output of an error amplification unit configured to generate the first compensation signal and an input of a buffer configured to generate the second compensation signal; and a third pole between an output of the buffer and an input of a pass unit configured to generate the output voltage and the load current.

* * * * *